United States Patent [19]

Jones

[11] Patent Number: 4,660,503

[45] Date of Patent: Apr. 28, 1987

[54] METHOD AND APPARATUS FOR IMPROVING A MULTI-COLOR ELECTROPHOTOGRAPHIC IMAGE

[75] Inventor: Robert S. Jones, Rochester, N.Y.

[73] Assignee: Eastman Kodak Company, Rochester, N.Y.

[21] Appl. No.: 837,973

[22] Filed: Mar. 10, 1986

[51] Int. Cl.[4] ..... G03G 15/01; G03G 15/10

[52] U.S. Cl. ..... 118/645; 118/652; 430/44; 430/125; 430/117

[58] Field of Search ..... 118/652, 645; 430/125, 430/44

[56] References Cited

U.S. PATENT DOCUMENTS 3,663,219 5/1972 Takahashi ..... 118/652
4,336,994 6/1982 Banton ..... 430/44 X

OTHER PUBLICATIONS

IBM Technical Disc. Bul. vol. 12, No. 7, 12/1969.

*Primary Examiner*—John D. Welsh

*Attorney, Agent, or Firm*—Robert L. Randall

[57] ABSTRACT

An improvement in the method and apparatus for producing a multi-color electrophotographic image wherein an electrophotographic medium is mounted on a carrier therefor and is translated over a predetermined path so that the medium is first charged, then exposed to a first light-borne image and then toned. Thus, the unexposed portions of the image bearing charged region of the medium are toned, preferably by a liquid toner, to produce a first color visible image. The carrier is then returned to the first position to repeat the foregoing steps to charge the medium and to expose it to a second light-borne image and to tone the second image with a second toning element to produce a second color visible image. The improvement comprises the step of brushing the surface of the first toned image with a soft fibrous brush member after the first toning step and prior to the second charging step to remove material from the untoned portion of the medium without significantly altering the toned image.

23 Claims, 3 Drawing Figures

METHOD AND APPARATUS FOR IMPROVING A MULTI-COLOR ELECTROPHOTOGRAPHIC IMAGE

RELATED APPLICATIONS

The present invention provides a different solution to a similar problem addressed by copending application Ser. No. 886,143 filed in the name of Alexandrovich et al. on July 16, 1986.

BACKGROUND OF THE INVENTION

This invention relates to electrophoretic liquid development and more particularly to an improved method of plural stage development.

In the liquid development of electrostatic charge latent images, as in electrophotography and in other processes that form and develop electrostatic charge patterns, a substrate having a charge pattern on its surface is contacted with a liquid developer which is essentially a suspension of colloidal toner particles in an insulating liquid. Liquid developers normally contain also a stabilizer or charge control agent. The latter is an ionic compound which controls the magnitude of the charge on the toner particles and aids in maintaining a stable charge on the toner particles within the insulating carrier liquid.

Liquid developers can be used in single stage or plural stage development processes. Examples of the latter may include the sequential development on a photoconductor of two or more color-separation images, the annotation of a previously developed image, or the repeated re-exposure of and development of images on a reusable photoconductor, with transfer of images after each development.

In certain plural stage development processes which use liquid developers a problem has been found which is especially significant in processes for the electrophotographic reproduction of multi-color images of graphic arts quality. In these processes electrostatic latent images are formed sequentially on a chargeable substrate such as an electrophotographic medium, with liquid development or toning of each latent image before the next is formed. A leading example of this kind of process involves exposing an electrophotographic medium sequentially through a series of four registered color-separation transparencies with four sequential development or toning stages. The problem encountered in this kind of process is that image defects occur in development of charge patterns in areas of the substrate which are background or untoned areas of a previous stage. The defect appears as an image in the previously untoned areas which is dull and has a low, non-uniform solid density, a defect which, though perhaps acceptable in some kinds of add-on, plural stage imaging, is not aceptable for producing high quality images as required, for example, in the graphic arts field.

It has been discovered that the described image defects an plural-stage liquid development appears to be caused by the presence of forces of substances in the previously untoned areas that interfere with subsequent development in those areas. Although the nature of those forces or substances is not clear, the present invention provides a method and apparatus that reduces or eliminates the problem.

The method of the invention comprises uniformly charging a photoconductive element, exposing the photoconductive element to a pattern of actinic radiation to form a latent electrostatic image, developing the latent image with a liquid developer composition comprising a carrier liquid, a toner and charge control agent, rinsing the developed surface of the photoconductive element with a rinse solution, thereafter again charging the surface of the photoconductive element, again exposing it to a pattern of actinic radiation to form a latent electrostatic image and developing the image with a liquid developer.

In a preferred embodiment, the charge control agent in the liquid developer is a polymeric organo-lithium compound, and the carrier liquid and the non-polar liquid of the rinse solution are volatile hydrocarbon liquids.

The method of the present invention is useful in any electrostatic imaging process wherein a charge pattern is formed and developed with a liquid developer on a surface which has previously been developed with a liquid developer. It is particularly useful, however, in combination with a recently developed electrophotographic method of making lithographic color proofs. This new method is described in the copending U.S. patent application of Ng et al., Ser. No. 773,528 filed Sept. 6, 1985. In this method a photoconductor which has a uniformly charged thin transparent dielectric overlayer is subjected to a series of exposures through registered color separation transparencies. After each exposure the dielectric layer is developed with a liquid developer, the surface is again uniformly charged and exposed. The sequence is repeated for each of the color transparencies, usually four.

Although we do not wish to be bound by any theoretical explanation or mechanism of the invention, a possible explanation for the results observed in the method of the invention is that the buffing of the developed substrate or photoconductor removes from untoned areas of the substrate a deposit of counterions which in some manner interfere with image development. These counterions are believed to originate from the charge control agent of the liquid developer. They are opposite in charge to the toner particles and deposit in the untoned or non-image areas of the substrate. When, in a subsequent stage, toner is applied to charge patterns in such areas, the toner is initially attracted to them. Within a short time, however, the acceptance of the toner is evidently affected because a dull, low, non-uniform solid density toned image occurs in such areas.

SUMMARY OF THE INVENTION

Accordingly, the present invention provides a method and apparatus for producing a multi-color electrophotographic image that enhances the image by removal of the contaminant counter-ion particles from the untoned portions of the image. Although the improvement provided by the present invention is simple and relatively easy to implement at a nominal cost, it does not have any significant negative effects on the resulting image.

According to one aspect of the present invention, a method for producing a multi-color electrophotographic image is provided which comprises the steps of providing an electrophotographic medium on a carrier therefor at a first position, translating the carrier and medium together over a predetermined path, charging the medium at a second position, and exposing the medium to a first light-borne image at a third position. The image is then toned in the unexposed portions of the image-bearing charged region to produce a first color visible image. The carrier and medium are then returned to the first position to repeat the foregoing steps to charge the medium and to expose it to a second light-borne image and to tone the second image with a second toning element to produce a second color visible image. The improvement of the present invention comprises the step of brushing the surface of the first toned image with a soft fibrous brush member after the first toning step and prior to the second charging step to remove material from the untoned portion of the medium without significantly altering the toned image.

According to another aspect of the present invention, apparatus is provided for carrying out the method of producing the multi-color electrophotographic image.

According to yet another aspect of the present invention, the brush member is formed as a rotating element which is rotated in a direction opposite to the direction of movement of the carrier during the brushing step.

According to a still further aspect of the present invention, the method and apparatus is provided for forming the image with liquid toners.

According to another aspect of the present invention, the brush is formed of a soft fibrous material selected from the group consisting of rayon, nylon and acrylic fibers.

Various means for practicing the invention and other features and advantages thereof will be apparent from the following detailed description of illustrative preferred embodiments of the invention, reference being made to the accompanying drawings.

DESCRIPTION OF THE PREFERRED EMBODIMENTS

Although the present invention is applicable to various electrophotographic elements, methods and apparatus, the embodiment to be described is directed to a multi-color electrophotographic image producing apparatus employing an electrophotographic medium of the type disclosed in the above-identified copending application.

Figure 1:
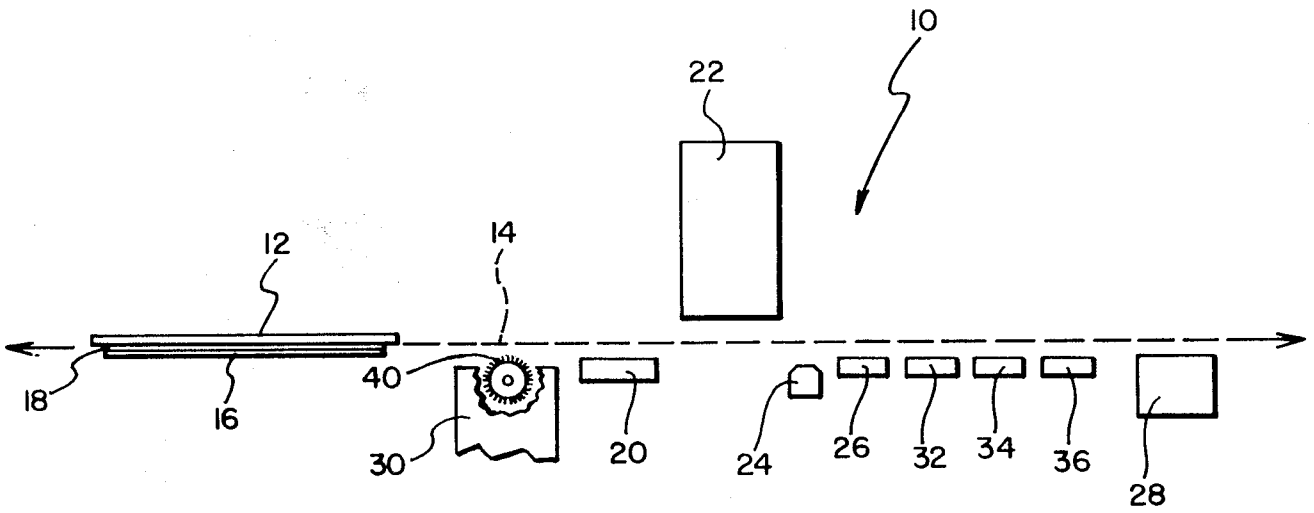
FIG. 1 is a schematic illustration of apparatus for carrying out the method of producing a multi-color electrophotographic image in accordance with the present invention.

A schematic illustration of a multi-color electrophotographic image processor is illustrated in FIG. 1 and consists of a carrier or platen 12 which is movable along the processing path, represented by dotted line 14, past the respective processing stations of the apparatus, to be described hereinafter. The path 14 may be determined by guide rails or other structure of the apparatus in a manner well-known in the art whereby the platen may move from a first position, illustrated, to the right-most position and then returned to the left to the starting position. The platen 12 is preferably transparent and is provided with means, not shown, for retaining an electrophotographic medium 16 on the lower surface thereof with an image-bearing transparency 18 disposed therebetween which is used to generate the image in the electrophotographic medium 16, in a manner more thoroughly described hereinbelow.

As noted in the above-cited copending application, the electrophotographic medium comprises a photoconductive layer on an electrically conducting substrate which is capable of transmitting actinic radiation to which the photoconductive layer is responsive. A dielectric support is releasably adhered to the substrate and comprises the photoconductive layer or an overcoat thereof which forms an outer surface of the element capable of holding an electrostatic charge. To use the element the surface of the dielectric support is charged and the photoconductive layer is image-wise exposed to the actinic radiation, thereby forming a developable electrostatic image on the dielectric surface. The electrostatic image in turn is developed with a toner to form a first color image. A composite color image can be formed on the element by repeating the sequence one or more times with image-wise exposure of the photoconductive layer to actinic radiation transmitted through the transparent support, and developing over each preceding image with a different color toner. The composite toned image is then transferred with the dielectric support to a receiving element to form a color copy which may be a color proof closely simulating the color print expected from a color print press.

Accordingly, the electrophotographic medium 16 is mounted onto the platen 12 with the transparency original 18, which may be a color separation representing a color to be printed, sandwiched therebetween. The electrophotographic medium 16 and the transparency original 18 may be held to the platen 12 by any suitable means known in the art such as a vacuum clamp whereby they are maintained in close proximity to assure satisfactory exposure, processing and registration. Further, the electrophotographic medium must also be suitably grounded to the apparatus to enable the charging processing to be satisfactorily carried out. A number of grounding means are known in the art and will not be described herein. As the platen 12, with the original and the electrophotographic medium 16, is translated to the right (in FIG. 1), the dielectric support of the electrophotographic medium is given an overall charge via a charging means 20, such as a corona charger, to form a uniform potential on the surface of the dielectric support. Upon being so charged the electrophotographic medium is image-wise exposed by passing beneath an exposure lamp apparatus 22 which projects light through the transparent platen 12, the transparency original 18, and through the transparent conductive substrate of the electrophotographic medium. When the photoconductive layer is thus image-wise exposed, mobile charge carriers, in this case positively charged holes, are formed in the photoconductive layer and migrate towards the interface of the photoconductive layer and the conducting layer as described in the above-identified application. Accordingly, the electric field strength in exposed regions is diminished while the field strength in unexposed regions remains approximately the same. As a result, an electrostatic differential pattern is formed on the dielectric support corresponding to the pattern on the transparency original.

The platen continues its movement, to the right in FIG. 1, passing over a pre-rinse head 24 which is fixed in position whereby the fluid head provided thereat when activated contacts the lower surface of th electrophotographic medium as it passes in the processing direction, i.e., to the right, but does not contact the medium when the fluid head is inactivated as when the platen is moved to the left in FIG. 1, to the original position. The pre-rinse head prewets the medium with a dispersant dielectric liquid prior to the liquid toning step. Thereafter, the platen moves past a raised first liquid toning station 26 which is raised into operating position whereby the lower surface of the electrophotographic medium is contacted and a toner image is imparted thereto, in a manner well-known in the art. In this system, the liquid toner is deposited in the unexposed, still charged area of the electrophotographic medium thereby forming an image which is a duplicate of the image carried by the transparency 18. (It is well-known in the art that negative images can also be produced with similar electrophotographic processes wherein the charges imparted to the electrophotographic medium and the toners are appropriately adjusted to give a negative image.) The platen continues movement to the right in the illustration, past appropriate rinse heads and dryers, not shown. The last station 28 at the right end of the apparatus is an erase lamp that exposes the electrophotographic medium after the toning operation to expose those parts of the photoconductor layer that were not exposed by the original image exposure so that the entire electrophotographic medium has substantially the same exposure history.

The platen 12 is then reversed and is returned to the first position illustrated in FIG. 1. At this point the first original transparency or color separation 18 is removed and replaced by a second transparency or color separation and registered with the electrophotographic medium 16 preparatory for the next pass through the apparatus to generate the second color image. When the electrophotographic medium 16 and the next original sheet 18 are re-registered on the platen 12, the platen is moved to the right again for charging, exposure and subsequent toning. However, the platen first passes over a brush or buffing station 30 which is raised into operative position with respect to the electrophotographic medium surface, whereby the brush bristles engage the toned image and lightly buff it before the platen reaches the charging station 20. The brush is rotated in a counter-clockwise direction while the platen is moving from left to right so that the brush bristles move in a direction opposite to the movement of the surface of the electrophotographic medium.

The platen then moves to the charging station 20 where the electrophotograhic medium is again charged and then moves to the exposure position 22 where light again is projected through the platen and the second color separation 18 to selectively charge the photoconductive layer in accordance with the transparency or color separation then in contact with the electrophotographic medium. Thereafter, the platen moves the electrophotographic medium to the pre-rinse station 24 and then to a second toning station 32 which is in operative position to tone the surface of the electrophotographic medium with a second color toner to produce a second color visible image overlying the first image. The platen subsequently moves past the aforementioned rinse and drying stations and again past the erase exposure station 28 before being returned to the first position at the left-hand end of the apparatus. Should it be desired to create a four color image (or a three color plus black image), the charging, exposing, and toning steps will be repeated for two more color separation originals with the platen and electrophotographic medium being moved into operative contact with an additional two toning stations 34 and 36, one for each of the additional colors. Prior to each of these additional exposing and toning steps the buffer brush mechanism is raised into brushing contact with the surface of the electrophotographic medium as the platen begins its travel to the right to again brush the toned medium to remove toning materials from the untoned portions thereof without significantly altering the toned image, as previously described. It will be appreciated that, as known in the art, the toning order may not necessarily be represented by the physical order of the toning stations in the apparatus, and the order given above is by way of example only.

After the final toning , rinsing, and drying steps, the platen 12 is returned to the first position where the electrophotographic medium is removed. On the final return of the platen the buffing brush is again raised into the operative position to buff the final image. In keeping with the desire to rotate the brush in a direction counter to the direction of travel of the electrophotographic medium, the brush is rotated in a clockwise direction (as viewed in FIG. 1) for this operation. While there are no additional toning operations to be conducted on the medium at this point, it has been found that the final brushing step aids in the lamination of the image-bearing release layer of the film to the paper stock, minimizing artifacts that have been found to occur without this final brushing operation.

Figure 2:
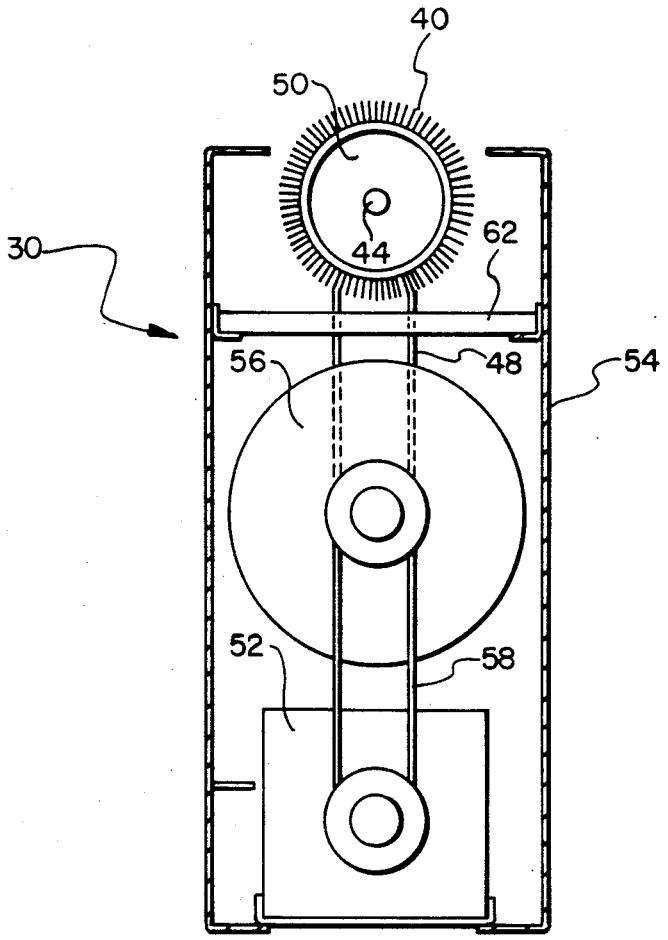
FIG. 2 is a cross-sectional view through the brushing mechanism taken along line 2—2 of FIG. 3.
Figure 3:
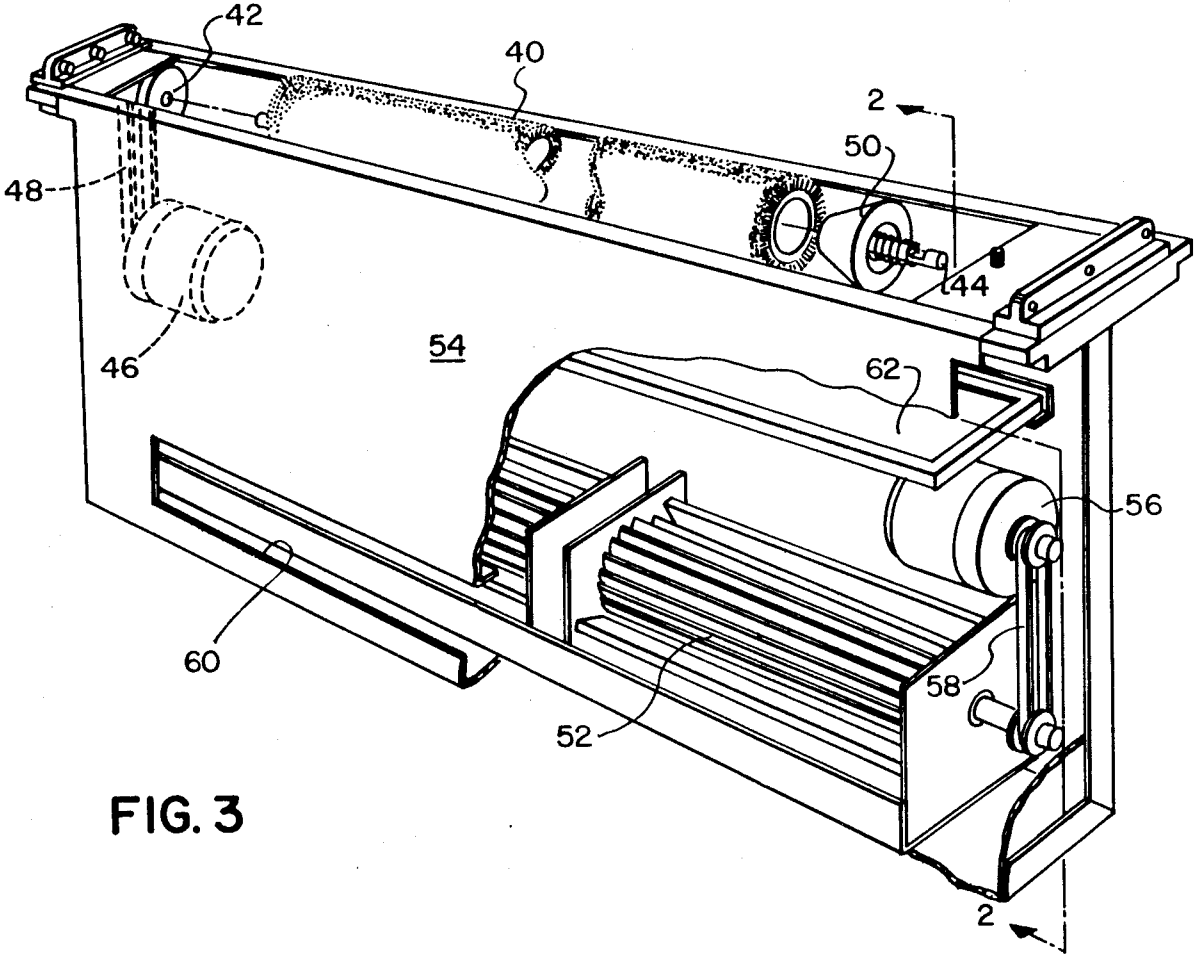
FIG. 3 is a perspective view, partially in section, of the brushing apparatus.

While the other components of the electrophotographic apparatus described herein are known in the art, the buffing brush assembly is described in further detail with respect to FIGS. 2 and 3. As illustrated, the buffing brush assembly takes up little space along the travel length of the apparatus, being only wide enough to mount the brush itself and the ancillary components. In the embodiment illustrated, the buffing brush assembly is a self-contained assembly carrying the the necessary structural members to support the brush assembly and its drive, and can be readily dropped into the allocated position in the electrophotographic apparatus. Thus the brush 40 is journaled in the upper edge of the brush assembly at 42 and 44 for rotation about its axis, driven by a reversible motor 46 mounted below the brush and connected thereto via a belt 48. One end of the brush may be provided with a spring loaded hub 50 which facilitates the removal and replacement of the brush itself. An exhaust fan 52 is disposed in the lower portion of the brush housing 54 and is driven by a fan motor 56 connected thereto via belt 58. This fan is intended to withdraw any particles or vapor removed from the electrophotographic medium by the rotating brush and to expel it to a suitable exhaust via opening 60 in the lower portion of the casing 54. A filter element 62 may be disposed between the brush 40 and the fan 52 to remove any particulate material removed from the medium by the brush.

One example of a buffing brush is made of rayon fiber which provides an optimum buffing action. The length of the brush is equal to or greater than the width of the electrophotographic medium and the core of the brush has a diameter of three inches. The length of the bristle is approximately 0.6 inches and the buffing brush assembly is arranged to engage the electrophotographic medium with a 0.062 inch fiber penetration so that a nip of between 0.75 and 1.0 inch is effected with the medium. The brush is rotated at a speed of 1700 to 1800 rpm. The bristle has 125 tufts per square inch and is formed from a rayon material having 80 filaments per tuft with a total of 300 denier per tuft. While rayon has been found to be the preferred fiber material, it has also been found that acrylic and nylon fibers are also satisfactory.

While the buffing brush assembly has been disclosed as being preferably located between the first, loading station and the charging station, it will be appreciated that it can also be located to the right of the erase lamp 28. The location of the brushing assembly between the first loading position and the charging station provides the advantage that the toned electrophotographic medium has had the maximum opportunity to dry prior to brushing without necessitating an unduly long waiting time. However, if time is not of the essence then the platen can be arranged to stop prior to a brushing station to the right of the erase exposure lamp, so that the toned image is sufficiently dry to permit brushing at that location.

It has been found that with the use of the buffing brush of the present invention, the multi-color electrophotographic images are enhanced by removal of undesired counterions from the untoned areas of the image. Moreover, it has been found that such brushing does not remove or damage the image dots nor does it decrease the image density. Still further, it has been found that this brushing does not modify the gloss of the image and it reduces or eliminates release of pre-image toner from the medium into the rinsing station. Still further, the present invention helps to reduce the background density, giving a lower $D_{min}$ to the image generated. Yet further, the use of the present invention results in a reduction in the magnitude of image defects such as banding or worms.

The invention has been described with reference to specific embodiments and variations, but it should be apparent that other modifications and variations can be made within the spirit and scope of the invention, which is defined by the following claims.

I claim:

1. In a method for producing a multi-stage electrophotographic image comprising the steps of providing an electrophotographic medium on a carrier therefor at a first position, translating the carrier and medium together over a predetermined path, charging the medium at a second position, exposing the medium to a first light-borne image at a third position, providing a first toning element arranged to engage the medium at a fourth position and toning the unexposed portions of the image bearing charged region of the medium to produce a first visible image, and returning the carrier to the first position to repeat the foregoing steps of charging said medium, exposing it to a second light-borne image and toning said second image with a second toning element to produce a second visible image, the improvement comprising the step of brushing the surface of the first toned image with a soft fibrous brush member after said first toning step and prior to the second charging step to remove material from the untoned portion of the medium without significantly altering the toned image.

2. The method according to claim 1 including the step of providing said brush in the form of a rotating element and the step of rotating said brush in a direction opposite to the direction of movement of said carrier during the brushing step.

3. The method according to claim 1 wherein said toning element is provided with a liquid toner and said brushing step is performed after said image has dried.

4. The method according to claim 1 including the step of moving the brush member out of contact with said medium except during the brushing step.

5. In a method for producing a multi-color electrophotographic image comprising the steps of providing an electrophotographic medium on a carrier therefor at a first position, translating the carrier and medium together over a predetermined path, charging the medium at a second position, exposing the medium to a first light-borne image at a third position, providing a first toning element arranged to engage the medium at a fourth position and toning the unexposed portions of the image bearing charged region of the medium to produce a first color visible image, and returning the carrier to the first position to repeat the foregoing steps of charging said medium, exposing it to a second light-borne image and toning said second image with a second toning element to produce a second color visible image, the improvement comprising the step of brushing the surface of the first toned image with a soft fibrous brush member after said first toning step and prior to the second charging step to remove material from the untoned portion of the medium without significantly altering the toned image.

6. The method according to claim 5 wherein said exposing and toning steps are repeated for four different images to produce a four color image.

7. The method according to claim 6 wherein said brushing step is performed after the first three toning steps.

8. The method according to claim 6 wherein said brushing step is performed after each toning step.

9. The method according to claim 1 including the step of removing toner components from said brush during the brushing step.

10. The method according to claim 3 including the step of prewetting the medium with a dispersant dielectric liquid after the exposure step and before the toning step.

11. The method according to claim 1 including the step of selecting the brush fibers from the group consisting of rayon, nylon and acrylic fibers.

12. Apparatus for producing a multi-stage electrophotographic image comprising means for providing an electrophotographic medium on a carrier therefor at a first position, means for translating the carrier and medium together over a predetermined path, means for charging the medium at a second position, means for exposing the medium to a first light-borne image at a third position, means for toning the unexposed portions of the image bearing charged region of the medium to produce a first visible image at a fourth position, and means for returning the carrier to the first position to repeat the foregoing steps of charging said medium, exposing it to a second light-borne image and toning said second image with a second toning means to produce a second visible image, the improvement comprising means for brushing the surface of the first toned image with a soft fibrous brush member after said first toning step and prior to the second charging step to remove material from the untoned portion of the medium without significantly altering the toned image.

13. The apparatus according to claim 12 including means for rotating said brushing means in a direction opposite to the direction of movement of said carrier during the brushing step.

14. The apparatus according to claim 12 wherein means is provided for supplying said toning means with a liquid toner and whereby said brushing step is performed after said image has dried.

15. The apparatus according to claim 12 including means for moving the brushing means out of contact with said medium except during the brushing step.

16. Apparatus for producing a multi-color electrophotographic image comprising means for providing an electrophotographic medium on a carrier therefor at a first position, means for translating the carrier and medium together over a predetermined path, means for charging the medium at a second position, means for exposing the medium to a first light-borne image at a third position, means for toning the unexposed portions of the image bearing charged region of the medium to produce a first color visible image at a fourth position, and means for returning the carrier to the first position to repeat the foregoing steps of charging said medium, exposing it to a second light-borne image and toning said second image with a second toning means to produce a second color visible image, the improvement comprising means for brushing the surface of the first toned image with a soft fibrous brush member after said first toning step and prior to the second charging step to remove material from the untoned portion of the medium without significantly altering the toned image.

17. The apparatus according to claim 16 wherein means is provided for exposing and toning said medium with four different images to produce a four color image.

18. The apparatus according to claim 17 wherein said brushing means is arranged to brush said medium after each of the first three toning steps.

19. The apparatus according to claim 17 wherein said brushing means is arranged to brush said medium after each toning step.

20. The apparatus according to claim 12 including means for removing toner components from said brushing means during the brushing step.

21. The apparatus according to claim 14 including means for prewetting the medium with a dispersant dielectric liquid after the exposure step and before the toning step.

22. The apparatus according to claim 12 wherein said brush fibers are selected from the group consisting of rayon, nylon and acrylic fibers.

23. In the method of producing a multi-stage electrophotographic record in which successively formed electrostatic images of predetermined polarity are sequentially developed in superposition on an electrophotographic medium with electroscopic toner, the improvement comprising, the step of brushing the surface of the developed image with a soft fibrous brush member between the developing of one electrostatic image and the forming of the next image to remove material from the untoned portion of the medium without significantly altering the developed image.

* * * * *